United States Patent [19]

Karnofsky

[11] 4,448,667

[45] May 15, 1984

[54] PROCESS FOR SOLVENT EXTRACTION OF BITUMEN FROM OIL SAND

[75] Inventor: George B. Karnofsky, Pittsburgh, Pa.

[73] Assignee: Dravo Corporation, Pittsburgh, Pa.

[21] Appl. No.: 451,331

[22] Filed: Dec. 20, 1982

Related U.S. Application Data

[63] Continuation-in-part of Ser. No. 240,541, Mar. 4, 1981, abandoned, which is a continuation-in-part of Ser. No. 41,769, May 27, 1979, abandoned.

[51] Int. Cl.[3] ..... C10G 1/04

[52] U.S. Cl. ..... 208/11 LE; 208/8 LE

[58] Field of Search ..... 208/11 LE

[56] References Cited

U.S. PATENT DOCUMENTS

| | | | |
|---|---|---|---|
| 2,663,624 | 12/1953 | Hutchins et al. | 422/268 |
| 3,459,653 | 8/1969 | Benson | 208/11 LE |
| 3,644,194 | 2/1972 | Kelly | 208/11 LE |
| 3,660,268 | 5/1972 | Kelly et al. | 208/11 LE |
| 3,856,474 | 12/1974 | Pittman et al. | 208/11 LE |
| 4,071,434 | 1/1978 | Gilford | 208/11 LE |
| 4,120,775 | 10/1978 | Murray et al. | 208/11 LE |
| 4,139,450 | 2/1979 | Hansen et al. | 208/11 LE |
| 4,221,764 | 9/1980 | Saxon | 422/268 |
| 4,229,281 | 10/1980 | Alquist et al. | 208/11 LE |

*Primary Examiner*—Delbert E. Gantz
*Assistant Examiner*—A Pal
*Attorney, Agent, or Firm*—Parmelee, Miller, Welsh & Kratz

[57] ABSTRACT

A continuous process for extraction of bitumen from oil sand by a hydrocarbon solvent wherein the sand is classified so as to produce a major coarse fraction and a minor fines fraction, with both fractions contacted with solvent to wash miscella therefrom, and wherein the major coarse fraction is contacted with solvent by gravity percolation and the classification of the sand is effected to remove sufficient fine material to achieve a flooding rate in the gravity percolation of between 1 and 4 gallons per minute per square foot.

3 Claims, 1 Drawing Figure

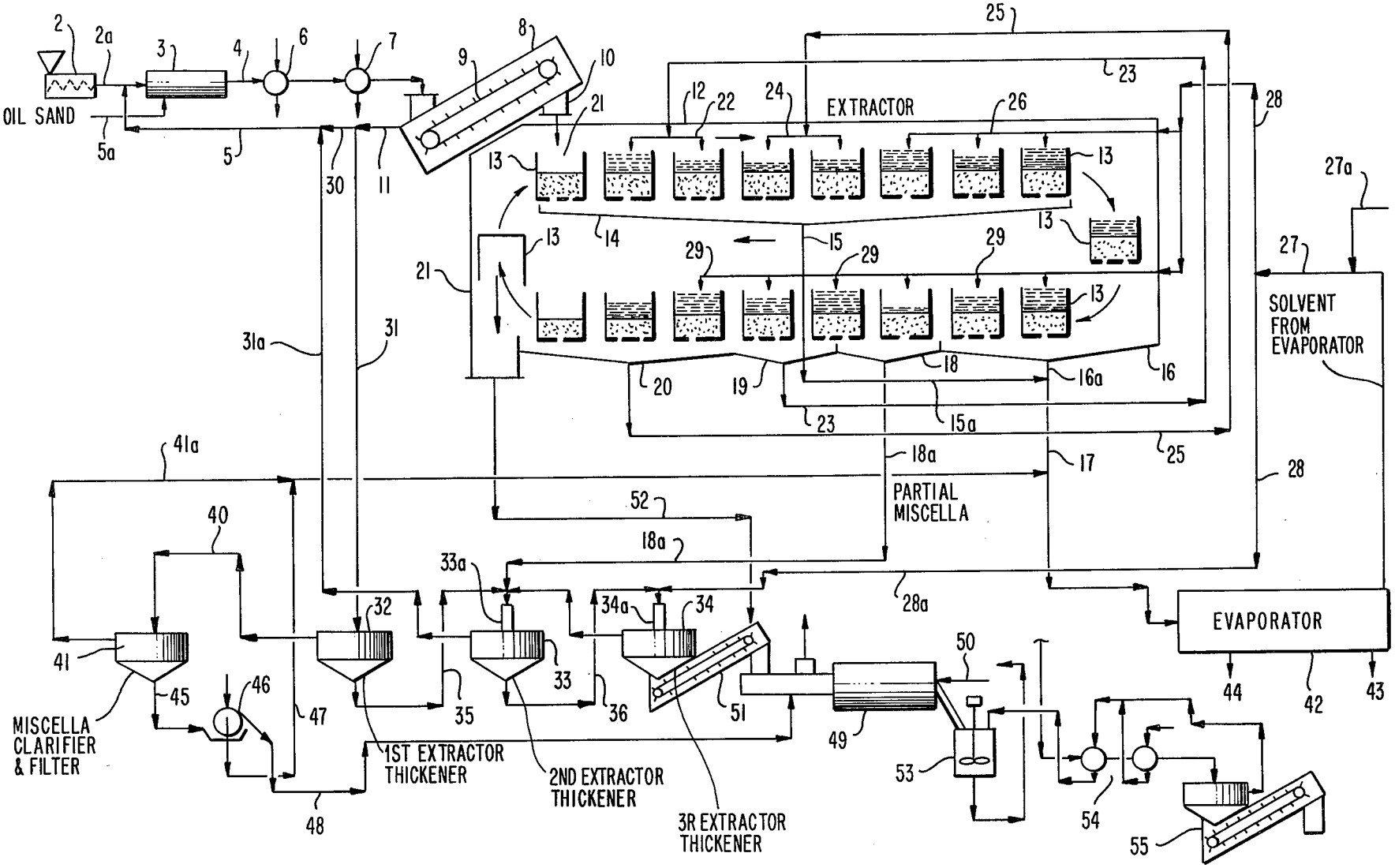
SOLVENT FROM EVAPORATOR
EVAPORATOR
EXTRACTOR
PARTIAL MISCELLA
3R EXTRACTOR THICKENER
2ND EXTRACTOR THICKENER
1ST EXTRACTOR THICKENER
MISCELLA CLARIFIER & FILTER
OIL SAND

PROCESS FOR SOLVENT EXTRACTION OF BITUMEN FROM OIL SAND

This application is a continuation-in-part of my application Ser. No. 240,541 filed Mar. 4, 1981 which was a continuation-in-part of my application Ser. No. 41,769 filed May 23, 1979 now both abandoned. Both said applications are for the extraction of bitumen from oil sand and both are incorporated herein by reference.

Bitumen so extracted provides a crude product for cracking in petroleum refineries. Oil sand is also commonly referred to as "tar sand" and the two terms are interchangeably used. The sand is comprised of granular particles of irregular shapes, and in the same deposit may, for the most part, range in size from a maximum of 20 mesh down to a few microns. As used herein, oil sand or tar sand refers to more or less loosely occuring sand particles, and to hard but easily dispersed sand particles, cemented by bitumen, and also to crushed sandstone in the pores of which oil or bitumen too viscous to flow is contained. Some oil sands may be directly usable in the present process, while other oil sands may require treatment so as to break up hard lumps of the material. The oil sand should be in the form of discrete sand particles formable into a slurry for processing according to the present process.

It is well known that oil or bitumen can be extracted with a solvent, generally a volatile hydrocarbon or combinations of volatile hydrocarbons. This is easily accomplished in a beaker in the laboratory. However, realization of a commercial process is not at all easy. Any process to be commercially feasible must be capable of effectively removing the bitumen from many thousands of tons of sand per day with safety and be environmentally acceptable, as well as economically profitable.

I am not aware of any solvent extraction process now in commercial operation for effecting the removal of bitumen from tar sand, or under construction anywhere. This is so, notwithstanding widespread interest, as indicated by prior patents in this field. Worldwide use of solvent extraction in the production of vegetable oils from seeds, as for example, soybeans, cottonseed, rapeseed, etc., with which I have had considerable experience, can not be translated to the solvent extraction of bitumen from oil sand. Bitumen is removed from oil sand at the present time by processes, of which I am aware, which are not solvent extraction processes and which have serious drawbacks.

Processes employed in solvent extraction of oil from crushed vegetable seeds cannot be applied directly to oil sands because seeds and sand differ so much in physical properties. These are: the differences in densities, the heterogenous mixture of grains of different sizes and shapes of sand as it is removed from the earth as compared to the generally uniform contour and size and specific gravity of seeds. Another difference is that a plant for sand processing, is to be economical, must be capable of efficiently, safely, and economically processing at least 50,000 tons of sand every 24 hours in order to be commercially profitable, whereas a very large oil seed plant processes about 3,000 tons per 24 hours.

This invention provides, in a unitary process where each contributes to the other, for extraction by gravity percolation of the major portion of the sand, and the simultaneous washing and recovery by decantation of the fines which interfere with percolation. By gravity percolation, I mean washing with a liquid solvent by repeated gravity flow through a granular mass.

BRIEF DESCRIPTION OF THE PRESENT INVENTION

An oil sand from one of several areas in which the coarser grains, those larger than screen size 50, predominate is preferable. These oil sands are never free of fines. The oil sand is mixed with hot partially oil-enriched miscella earlier produced by this process, to dissolve the bitumen away from the sand in the feed and produce a slurry of sand in bitumen-enriched miscella. This slurry is discharged into a classifier in which the larger coarser particles settle by gravity to the bottom, and the finer lighter particles are carried in the liquid overflowing the classifier. The purpose of classification is to remove sufficient of the fine material so that the remaining coarse material can be formed into beds through which solvent will percolate by gravity at a practical rate. In the present process, a flooding rate of 1–4 gpm/ft$^2$ can be achieved by the removal in the fines fraction of less than about 15 percent of the sand.

The coarser sand that settles to the bottom is continuously removed from the bottom of the classifier by an inclined drag conveyor or the like, along with enough miscella to constitute a mixture sufficiently fluid that it can spread to form a homogenous bed. This mixture is directly loaded onto a continuously traveling perforated conveyor to form a bed from the bottom of which the miscella may quickly drain. The body of sand, still wet with miscella, is then repeatedly flooded with solvent as it is carried along by the conveyor, passing under spargers disposed at spaced intervals to replenish the solvent that has percolated through the bed. Typically, the bed will have some selected substantially uniform depth. The solvent will generally be at a level at or above the level of the bed of sand on the conveyor. When washing is terminated, all of the solvent that can is permitted to drain as the bed approaches a discharge station.

The overflow from the classifier containing fines is divided into two streams. One supplies some of the miscella fed to the slurry mixer and the other is processed by decantation to recover washed fines and to supply additional miscella to the mixer and also to supply a portion of the bitumen-rich final miscella. This is combined with the bitumen-rich miscella from the percolation extractor. The combined miscellas are evaporated in a multi-effect evaporator to recover solvent from the product bitumen. Solvent is recycled, preferably hot, for reuse in the process. Spent sand from the percolation extractor and processed fines from the extractor thickeners are delivered to a residue stripper to recover solvent by steam stripping.

BRIEF DESCRIPTION OF THE DRAWING

The method may be more fully explained and understood by reference to the accompanying drawing, in which:

The FIGURE is a schematic disclosure of substantially an entire plant for the practice of my invention.

DETAILED DESCRIPTION

Referring to the drawing, there is a sealed feeder 2 indicated by a feed screw through which oil sand is continuously delivered through conduit 2*a* to a mixer 3, as, for example, a rotating drum-type mixer having an outlet connection 4. There is a pipe 5 connected with the inlet to the mixer through which solvent-rich miscella, that has been previously produced in the continuous operation of the process, is introduced into the mixer. In the mixer, the sand and miscella are mixed and the solvent fraction of the miscella dissolves the bitumen from the sand and sand clusters or agglomerates. Water, or aqueous solution, for agglomeration of the sand in the mixer may be added through pipe 5*a*.

Slurry flows through the outlet connection 4 to heat exchanger means, indicated by heat exchangers 6 and 7, and into classifier 8. The classifier is indicated as an inclined vessel, in which there is a drag conveyor 9, and which has a discharge chute 10 at its upper end. The dotted horizontal line within the classifier indicates the level of the slurry in the classifier. In the classifier the slurry separates, with the coarser, heavier grains and agglomerates gravitating to the bottom while the finer particles gravitate more slowly, if at all. Most of the liquid entering with the slurry, carrying the fines, is removed from the classifier as overflow through pipe 11.

The main body of the coarse sand, comprising mostly particles greater than a 50-mesh screen size and any agglomerates or clusters contained in the underflow, is removed as bottoms from the classifier by the drag conveyor, along with adequate miscella to cause the slurry to spread and form a uniform bed on a percolation conveyor as hereafter explained.

The discharge chute 10 enters the top of percolator 12, enclosed to prevent loss of solvent vapor. The percolator comprises a continuously moving endless perforate conveyor of some sort that receives the slurry discharged from the chute 10 onto or into which the slurry may be deposited and flow to a generally uniform depth before the liquid has drained through the conveyor. Those areas of the conveyor on which the sand is carried have spaced holes therethrough for the drainage of miscella from the slurry, but across which coarse particles will bridge.

Successful employment of washing by gravity percolation is dependent on realizing practical percolation rates. I have found that little or no solvent will percolate by gravity through beds formed from unclassified oil sands, because there is always enough fine material to fill the voids between coarse particles. Practical percolation rates can be realized if a controlled amount of fines, less than 15% of the non-bitumen solids in the oil sand, is removed from the slurry of sand in miscella by controlled classification.

When solvent is continuously poured on to the top of a free-draining homogenous bed of sand, the amount of solvent in and above the bed depends on the pouring rate. At low pouring rates, the solvent does not fill the voids in the bed; and no solvent is visible above the top of the bed. At high pouring rates, the voids are filled, and there is a layer of free solvent above the top of the bed. At a particular pouring rate called the "flooding rate" solvent fills the voids, and free solvent just appears at the top of the bed.

The flooding rate for any given liquid is dependent on its viscosity and density, and is characteristic of the bed, but independent of the bed depth. Flooding rate is conventionally expressed in gallons per minute per square foot of horizontal bed area (gpm/ft$^2$). In the present process, flooding rates for oil-free solvent realized by controlled classification are in the range of 1–4 gpm/ft$^2$.

A most desirable percolator is one disclosed in U.S. Pat. No. 4,221,764 issued Sept. 9, 1980 to Arthur F. Saxon, incorporated herein by reference, and owned by my assignee corporation. The moving conveyor comprises an endless succession of long, narrow, trough-like, rigid buckets 13 extending crosswise of the enclosure, transverse to their direction of travel, of a length of perhaps twenty to thirty feet and a depth of the order of four feet. The slurry is charged into each successive bucket at a rate to only partially fill each bucket to a selected depth. Although not shown in the schematic drawing, said patent discloses "stream splitters" between each two buckets so that, as one basket moves from under chute 10, the stream splitters will prevent the slurry from falling into the spaces between successive buckets and divert the flow from a leading to a following bucket, as they also will do at succeeding stations where spargers subsequently discharge liquid into the path of the buckets.

Also as disclosed in the Saxon patent, the buckets are carried on endless chains that extend, as indicated in the drawing by arrows along an upper run, from left to right, as here shown, then travel down at the right without tipping the buckets, then along a lower return run to the opposite end where the buckets are inverted to discharge their load of spent sand, and then returned to an upright position to reach the start of the upper run.

Extending beneath the full length and width of the trays in the upper run of the conveyor is a drainage collecting tray 14 from which liquid collected in the tray is conducted through a pipe 15. Some of the drainage from the trays traveling down at the right end of the percolator, as here shown, and under the first few buckets, here schematically represented by the first two buckets at the right end of the lower run, is collected in tray 16 and this liquid flows through pipe 16*a* that joins pipe 15. The combined flow from pipes 15 and 16*a* is conducted by pipe 17 out of the enclosure for subsequent separation into solvent to be recycled and bitumen, as hereinafter explained.

Below the remaining buckets in the lower run are other drainage collecting trays, indicated as 18, 19 and 20. Tray 20 is the one at the left end of the lower run, terminating at the left just where the conveyor turns to travel to the beginning of the upper run and in advance of the upward travel of the buckets where they are inverted for discharge of spent sand into spent sand receiver 21.

As here diagrammed, there is a sparger 22 above the first two buckets immediately to the right of that one at the slurry receiving station 21. In this instance, the solvent supplied to the sparger through pipe 23 drains to tray 19 under the lower run of the conveyor at a zone where there is little bitumen in the solvent. There is a second sparger 24 above the succeeding two buckets in the procession. It is supplied through pipe 25 with weak miscella from the left end tray 20 of the lower series of trays. Miscella from sparger 24 is weaker than the miscella from sparger 22. This provides counterflow of solvent and the coarse sand in the first four buckets following the loading station. There are also spargers over the last three buckets of the upper run, these being designated 26, and they are supplied with hot solvent from the evaporator, and makeup solvent, through supply pipes 27 and 27*a* and pipe 28. Pipe 28 also supplies solvent to all of the spargers, designated as 29, over the buckets in the lower run. The last few buckets, here indicated as three, immediately in advance of the dumping station do not have any spargers above them or receive any solvent from any source so that the liquid contained in their respective charges of sand will have an opportunity to drain completely. It is to be understood that naming groups of buckets and spargers as "first two" and "next two," etc. is merely illustrative and that an actual percolator will doubtless have many more buckets and spargers.

The hydrocarbon solvent may be any of those heretofore known for this purpose. Generally, it will be effectively comprised, in part, of an aromatic or cyclic compound. Where cooling water is available for condensing solvent vapors, one suitable solvent comprises a mixture of hexanes with about 20% benzene or cyclohexane. If air cooling is used to condense vapors, a mixture of heptane with about 20% toluene is preferred. A suitable hydrocarbon solvent can also be derived by recycling, from the cracking process to which the product bitumen is conventionally subjected, a distilled fraction boiling in the range of 160°–210° F. Since water is often present, even being native to the sand, in the miscella the maximum extraction temperature is near the boiling point of the azeotropic mixture of hydrocarbons and water.

It is to be understood that the foregoing disclosure is essentially schematic, as there may be more or fewer buckets and more spargers, depending on the plant and the sand and the capacity and speed of travel of the buckets. Also, for clarity of illustration, pumps for circulating the liquid to the spargers are not shown either in connection with the percolator or any other parts of the system.

The drawing schematically illustrates by dotted areas the generally uniform depth of solids in each tray, and after the first to the last two buckets the variable depth of solvent above the level of the solids to which the spargers fill the buckets at each station.

It may here be observed that because of the small scale and schematic nature of the drawing and for clarity of illustration on so small a scale, only a single bucket is shown in the down passage of the buckets at the right end of the drawing, so that the uniform spacing of the buckets is not accurately illustrated, either at this point in the diagram or at the opposite end of the percolator, but during the downward travel at the right end of the diagram drainage from an upper bucket will be received at least in part in the next lower one, so that while no spargers are shown over buckets in this area, actually the drainage above described will assure that the minimum level of the liquid in the down-traveling bucket will hold true, and not appreciably below the top of the bed of sand in the tray. Liquid from the descending buckets at the right end of the percolator will be caught in tray 16 into discharge pipe 16*a* to pipe 17, to which pipe 15 is connected through pipe 15*a*.

The slurry is hot when it flows into the buckets from the classifier, and the recycled solvent from the three-effect evaporator, in which bitumen and low boiling compounds are separated from the solvent, is also hot, that is, at the extraction temperature. The percolation rate of the slurry is thereby effectively increased.

It will be noted that the drainage from one of the trays, that is tray 18, is not recycled or combined with the miscella removed from other trays, but is removed through pipe 18*a*, marked "partial miscella." This will be hereinafter more fully explained.

The purpose of elutriating the sand particles in the classifier is, of course, because without elutriation all of the fines in the slurry would increase the density of the mass of slurry in the buckets of the percolator, rendering the slurry less pervious or completely impervious to the effective leaching or washing of the solvent through the mass to remove the bitumen-rich residuals therein.

As just explained, were it not for the removal of a substantial volume of fines before discharge of the slurry into the buckets, the fines would block the flow of solvent, or miscella of solvent and bitumen, through the charges of slurry in the buckets. However, the stream of slurry containing the fines retains a substantial part of the miscella discharged from the mixer and provision is made in this process for the recovery of that miscella from the elutriated fines.

The stream of miscella and fines removed from the classifier through pipe 11 as overflow, which comprises much more of the miscella entering the classifier than does the discharge of the stream of bottoms to the percolator, is in turn divided into two streams. Part of its flows through a connection 30 directly from the classifier into miscella supply pipe 5 for discharge into the mixer 3, providing at least part of the miscella previously produced that is returned to the mixer. Part of this overflow from the classifier flows through pipe 31 into the first of a succession of extractor thickeners, here shown as an assembly of three units, 32, 33 and 34, arranged for countercurrent decantation. The weight of fines flowing in line 31 is less than 15% and desirably less than 10% of the weight of sand in the oil sand fed to the process. Bottoms, comprising fines supplied principally through pipe 31, are conveyed through pipe 35 into in-line mixer 33*a* of the thickener 33 and are there combined also with the overhead from thickener 34.

Mixer 33*a* of thickener 33 is also supplied with solvent-rich or partial miscella delivered to it from percolator tray 18 through pipe 18*a*. Bottoms from thickener 33 are transferred through pipe 36 to the mixer 34*a* for the thickener 34. Hot solvent is supplied from the evaporator through pipe 28 and its extension 28*a*. Overhead from thickener 34 is combined with the partial miscella from pipe 18*a* which conducts partial miscella to the mixer 33*a* at the top of thickener 33, and overhead from 34 also is conducted into mixer 33*a*. It will thus be seen that miscella contained with the fines moves as bottoms toward the right, counter to the flow of solvent toward the left. The overhead, comprising miscella extracted from the fines in the second extractor thickener, instead of flowing directly into a mixer at the top of the first extractor thickener flows through pipe 31*a* to the mixer 3 which serves, in effect, as the mixer of the first extractor thickener stage 32.

Overflow from the first extractor thickener flows through pipe 40 into clarifier 41. Here, some of the fines still remaining in the miscella settle, some of the fines possibly agglomerating, and the clarified miscella is discharged as overflow into pipe 41*a*. This miscella joins miscella from the percolator in pipe 17, which then carries the entire output of bitumen-rich miscella from both the percolation and decantation steps of the process to the evaporator, preferably, as previously explained, a multiple effect evaporator, schematically indicated at 42. The evaporator is disclosed more fully in my copending application, Ser. No. 202,146 filed Oct. 30, 1980. Condensed solvent from this evaporator is carried through pipe 27, hereinbefore referred to, connecting into pipe 28. Product bitumen is withdrawn at 43. Low boiling hydrocarbons that may result from the process may be discharged at 44. Pipe 27*a* may supply makeup solvent to the system. The relatively low volume of fines that settle in the clarifier are withdrawn through pipe 45 and discharged into a continuous filter 46, represented as a revolving drum type filter. The filtered miscella thereby produced flows through pipe 47 into pipe 41*a* leading to the evaporator.

Residue fines collected from the filter 46 are carried through conduit 48 into the entering end of a residue stripper 49, which may be of the rotary drum type where steam enters at 50.

All of the fines comprising the bottoms from thickener 34 are carried and dumped by drag conveyor 51 to the entering end of the residue stripper. At the top of this stripper as diagrammed, all of the spent sand or residue from the bucket dump at the left end of the percolator is carried by conduit 52 to mix at the top of the drag conveyor, before entering the residue stripper, with the fines from the decanting system comprising the three thickeners. Hot solvent vapor leaving the residue stripper may be used as the heat source for the heat exchanger 7, as more fully disclosed in my said copending application and thereafter combined with solvent in line 28.

The heated sand which is discharged from the residue stripper 49 may be discharged into a residue mix tank 53 to heat water contained therein and the hot slurry so produced may be circulated to the heat exchanger 6 in line 4 and from there returned through a line, also shown in my said application, to heat exchange system at 54 to yield most of its remaining heat to the outflowing and makeup water that is discharged into the residue mix tank. Part of this water is recovered from a thickener 55 as overhead, the underflow from which is washed sand, as also more fully explained in my copending application Ser. No. 202,146 filed Oct. 30, 1980.

Once the percolator has been placed in operation, the flow of solvent and the recycle of solvent can be adjusted to meet the demands of the percolator. As previously explained, conventional pumps and valves for circulating liquids are not, for reasons of clarity, disclosed in the drawing, since their inclusion and location is a matter of engineering and relative disposition in each individual installation where gravity flow, for example, may replace pumps or pumps required to augment gravity, etc.

It has been known for some time (Benson U.S. Pat. No. 3,459,653) that the addition of water, or aqueous solutions, to the feed mixer 3 may result in the agglomeration of part of the fines. In experimental work, I found that addition of water to the feed mixer through line 5*a*, when used in conjunction with the teachings of my parent application, was indeed beneficial.Most oil sands respond to minimal mixing with miscella and water by forming agglomerates which, though still small, are large enough to be treated as coarse particles within the meaning of this invention. That is, the agglomerates are large enough so that, when separated from fines in a classifier, they form beds through which solvent can percolate at practicable rates. The fines fraction is correspondingly reduced. Consequently, when water is added through line 5*a*, the fines flowing in line 31 are for most oil sands less than 15% of the sand fed to the process. The thickeners 32, 33 and 34 become inordinately large if the fraction of the sand that needs to be washed by countercurrent decantation is larger than 15%.

With the process herein disclosed where a portion of the stream of fines from the classifier is returned to the mixer one or more times, some of these fines can and do agglomerate. Other particles, so far as I have determined, are immune to agglomeration, at least for practical purposes. My process of washing by continuous decantation a part of the stream of fines from the classifier assures effective recovery of miscella and bitumen from these unagglomerated fines.

As disclosed in my copending application filed Oct. 30, 1980, Ser. No. 202,146, hot solvent from the stripper and heat recuperated from the hot stripped sand may be supplied to the heat exchangers 6 and 7, although this may not necessarily be the source of heat for heating the slurry. Hot solvent from the evaporator is delivered through pipe 27 to the percolator and to the third extractor thickener. Slurry recycled from the classifier and extracted miscella in line 31*a* from the second extractor thickener is also hot, so that the entire process is carried out hot, that is, at a temperature to maintain the high fluidity of slurry and miscella required for effective performance of the extraction process. Enclosure of all operation including the percolator and, though not indicated, of the filter 46 from the ambient air prevents the loss of solvent vapors for safety and protection of the environment.

My process provides unitary processing of coarse and fines, with simultaneous but separate nonconflicting extraction of coarse and fine sands, with, however, stages of common mixing, recovery of solvent and bitument in a common evaporator, simultaneous but noninterfering gravity percolation of coarse particles and decantation of fines, transfer of miscella from the gravity percolation to the decantation process, and the two-source supply of recycled miscella to the mixer. This contributes to a common result, to good thermal efficiency and to reduced plant operating expense and initial plant investment which could not be achieved in the absence of independent processing of the coarse and fine particles.

It will also be particularly noted that all clear hydrocarbon solvent, whether it be fresh makeup-solvent or reclaimed solvent which has been recovered from the multi-effect evaporator solvent recovery is never first brought into contact with fresh incoming sand, at least in effective amounts, but it first contacts the sand in the last stages of the extraction process. In other words, clear volatile hydrocarbon solvent is introduced only into the final decanter (No. 32) of the multi-stage extractor thickener where it will most effectively extract the already lean miscella from the sand. In the gravity flow percolator the clear solvent is percolated through the final run of the baskets before the sand is dumped from the baskets. The clear solvent so introduced is then progressively advanced toward the sand-miscella input of slurry into the percolator. Percolation is effected entirely by gravity flow of solvent or miscella through the slurry as it is carried along by the conveyor.

I claim:

1. In a process for the continuous extraction of bitument from oil sand by a hydrocarbon solvent wherein the sand is in the form of discrete particles, and wherein the oil sand is mixed with a miscella recycled from the process to form a slurry and to dissolve the bitumen, and wherein said discrete particles in the slurry are classified to produce a major coarse fraction and a minor fines fraction, and wherein both fractions are contacted with the solvent to wash miscella therefrom, the improvement wherein:

the major coarse fraction is contacted with the solvent by gravity percolation and the classification of the sand in the slurry is effected so as to remove sufficient fine material from the slurry to achieve a flooding rate in said gravity percolation of between 1 and 4 gallons per minute per square foot.

2. In the process as defined in claim 1, the improvement wherein less than about 15 percent of the sand is in said fines fraction.

3. In the process of claim 1, the improvement wherein said contacting of the minor fines fraction with solvent is by countercurrent decantation.

* * * * *